US009228572B2

(12) United States Patent
Richardson et al.

(10) Patent No.: US 9,228,572 B2
(45) **Date of Patent: *Jan. 5, 2016**

(54) HYDRAULIC APPARATUS RETURN TO NEUTRAL MECHANISM

(75) Inventors: Jason Scot Richardson, Chuckey, TN (US); Jason Lee Emmette, Greeneville, TN (US); Richard C. Hynes, Chuckey, TN (US); Brook Cutshaw, Greeneville, TN (US); Somer R. Malone, Chuckey, TN (US); Michael T. Crosby, Jonesborough, TN (US)

(73) Assignee: Parker-Hannifin Corporation, Cleveland, OH (US)

( * ) Notice: Subject to any disclaimer, the term of this patent is extended or adjusted under 35 U.S.C. 154(b) by 747 days.

This patent is subject to a terminal disclaimer.

(21) Appl. No.: 13/457,800

(22) Filed: Apr. 27, 2012

(65) Prior Publication Data

US 2012/0275933 A1 Nov. 1, 2012

(51) Int. Cl.

| | |
|---|---|
| ***F15B 15/22*** | (2006.01) |
| ***F01B 13/04*** | (2006.01) |
| ***F04B 1/14*** | (2006.01) |
| ***F03C 1/06*** | (2006.01) |
| ***F03C 1/40*** | (2006.01) |
| ***F04B 1/20*** | (2006.01) |
| ***F04B 1/29*** | (2006.01) |

(52) U.S. Cl.

CPC ..... *F04B 1/146* (2013.01); *F03C 1/0668* (2013.01); *F03C 1/0686* (2013.01); *F04B 1/2078* (2013.01); *F04B 1/295* (2013.01)

(58) Field of Classification Search

CPC ..... F04B 1/146; F04B 1/2078; F04B 1/295
USPC ..... 92/12.2, 12, 130 D; 91/505; 74/839
See application file for complete search history.

(56) References Cited

U.S. PATENT DOCUMENTS

| | | | | |
|---|---|---|---|---|
| 3,541,878 | A | 11/1970 | Haffner | |
| 3,628,393 | A | 12/1971 | Houk | |
| 3,703,836 | A | 11/1972 | Kiser | |
| 4,271,918 | A | 6/1981 | Molby | |
| 4,375,771 | A | 3/1983 | Kobelt | |
| 6,782,797 | B1 | 8/2004 | Brandenburg et al. | |
| 6,968,687 | B1 | 11/2005 | Poplawski et al. | |
| 7,197,873 | B1 | 4/2007 | Windhorst et al. | |
| 7,313,915 | B1 | 1/2008 | Windhorst et al. | |
| 7,340,890 | B1 | 3/2008 | Poplawski et al. | |
| 7,654,170 | B2 | 2/2010 | Wittkopp | |
| 7,908,960 | B2 * | 3/2011 | Daigre | 92/12.2 |
| 2013/0145890 | A1 * | 6/2013 | Hynes et al. | 74/490.1 |

* cited by examiner

*Primary Examiner* — Edward Look
*Assistant Examiner* — Daniel Collins
(74) *Attorney, Agent, or Firm* — Robert J. Clark

(57) ABSTRACT

A hydraulic apparatus is provided with a return to neutral mechanism for returning a trunnion control bracket arm to a neutral position. The return to neutral mechanism comprises a pair of springs, one spring connecting a fixed bracket to a first rotatable bracket and the other spring connecting the fixed bracket to a second rotatable bracket. The mechanism uses springs with different spring constants and the springs are attached to the brackets in a single plane.

20 Claims, 6 Drawing Sheets

HYDRAULIC APPARATUS RETURN TO NEUTRAL MECHANISM

CROSS REFERENCE TO RELATED APPLICATIONS

The present application claims the benefit of the filing date of U.S. Provisional Application Ser. No. 61/479,563, filed Apr. 27, 2011, the disclosure of which is incorporated herein by reference in its entirety.

FIELD OF THE INVENTION

The invention herein described relates generally to a hydraulic apparatus with return to neutral mechanism.

BACKGROUND

Many hydraulic apparatuses, such as pumps or motors, include a device that is rotatable for varying the displacement of the apparatus. For example, on a hydraulic pump, such as an axial piston pump, a swash plate is connected to a trunnion arm that is rotatable for varying the displacement of the pump. More specifically, rotation of the trunnion arm rotates the swash plate to vary the displacement of a pumping unit of the hydraulic pump. When the swash plate is in a predetermined location, there is no displacement from the hydraulic pump. The position of the trunnion arm associated with this predetermined location of the swash plate is commonly referred to as the neutral position. Thus, when the trunnion arm is in the neutral position, there is no fluid displacement from the hydraulic pump. When the trunnion arm is rotated in a first direction from the neutral position, the swash plate rotates away from the predetermined location in a first direction and hydraulic fluid flows out of a first system port of the pump. Similarly, when the trunnion arm is rotated in a second direction, opposite the first direction, the swash plate is rotated away from the predetermined location in a second direction, opposite the first direction, and hydraulic fluid flows out of a second system port of the pump.

Mechanisms are associated with such hydraulic apparatuses for acting upon the trunnion to bias the trunnion into the neutral position. One such mechanism is shown in U.S. Pat. No. 6,968,687, hereby incorporated by reference.

SUMMARY

At least one embodiment of the invention provides a hydraulic apparatus comprising: a housing; a trunnion arm extending from the housing; a first bracket rotationally coupled to the trunnion arm; a second bracket fixed to the housing; a third bracket rotatable about the trunnion arm; a fourth bracket rotatable about the trunnion arm; a first biasing member biasing third bracket to move the first bracket toward a neutral position of the trunnion arm when the first bracket is rotated in a first direction; and a second biasing member biasing the fourth bracket to move the first bracket toward the neutral position of the trunnion arm when the first bracket is rotated in a second direction.

At least one embodiment of the invention provides a hydraulic apparatus comprising: a hydraulic apparatus, comprising: a housing; a trunnion rotatably mounted in the housing; a first bracket arm fixedly attached to the trunnion; a return to neutral assembly comprising: a second bracket fixed to the housing; a third bracket rotatable about the trunnion arm; a fourth bracket rotatable about the trunnion arm; a first biasing member attached to the third bracket and the second bracket, the first biasing member biasing the third bracket against the first bracket and toward a neutral position when the first bracket is rotated in a first direction; a second biasing member attached to the fourth bracket and the second bracket, the second biasing member biasing the fourth bracket against the first bracket and toward a neutral position when the first bracket is rotated in a second direction; wherein the fourth bracket does not move when the first bracket arm is rotated in a first direction and the third bracket does not move when the first bracket arm is rotated in a second direction.

At least one embodiment of the invention provides a method of returning a trunnion arm of a hydraulic apparatus to a neutral position when it is rotated away from the neutral position, the method comprising the steps of: providing a return to neutral mechanism having a first bracket arm fixedly attached to the housing, a second arm mounted to a housing of the hydraulic apparatus, a third and fourth bracket rotatable about the trunnion arm, and a first biasing member attached to portions of the second bracket and the third bracket that are positioned in a single plane, and a second biasing member attached to portions of the second bracket and the fourth bracket that are positioned in a single plane; biasing the first bracket arm toward the neutral position using the first biasing member when the first bracket arm is rotated in a first direction; and biasing the first bracket arm toward the neutral position using the second biasing member when the first bracket arm is rotated in a first direction.

BRIEF DESCRIPTION OF THE DRAWINGS

Embodiments of this invention will now be described in further detail with reference to the accompanying drawings, in which.

DETAILED DESCRIPTION OF THE DRAWINGS

Figure 1:
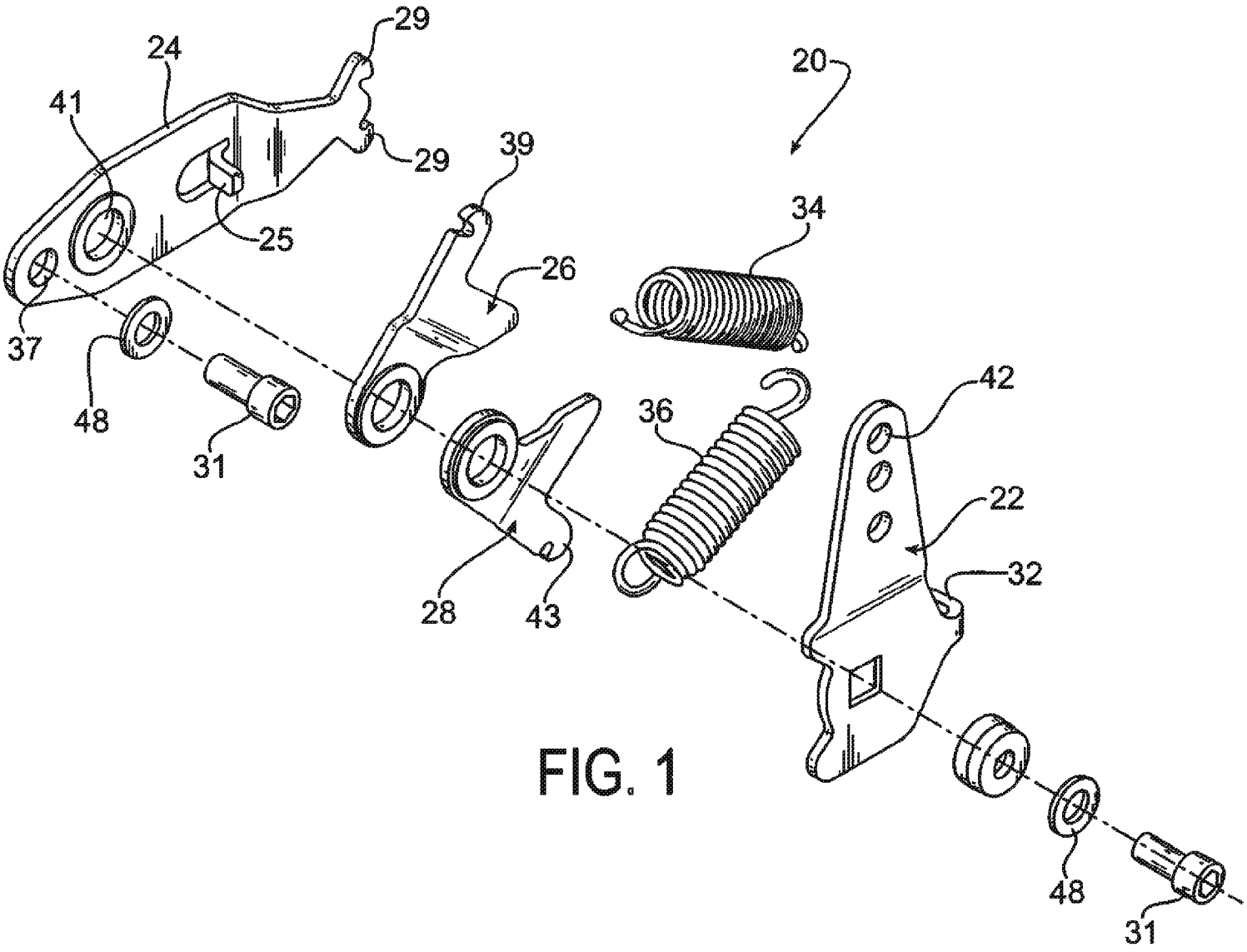
FIG. 1 is an exploded perspective view of a hydraulic apparatus return to neutral mechanism in accordance with an embodiment of the present invention.
Figure 2:
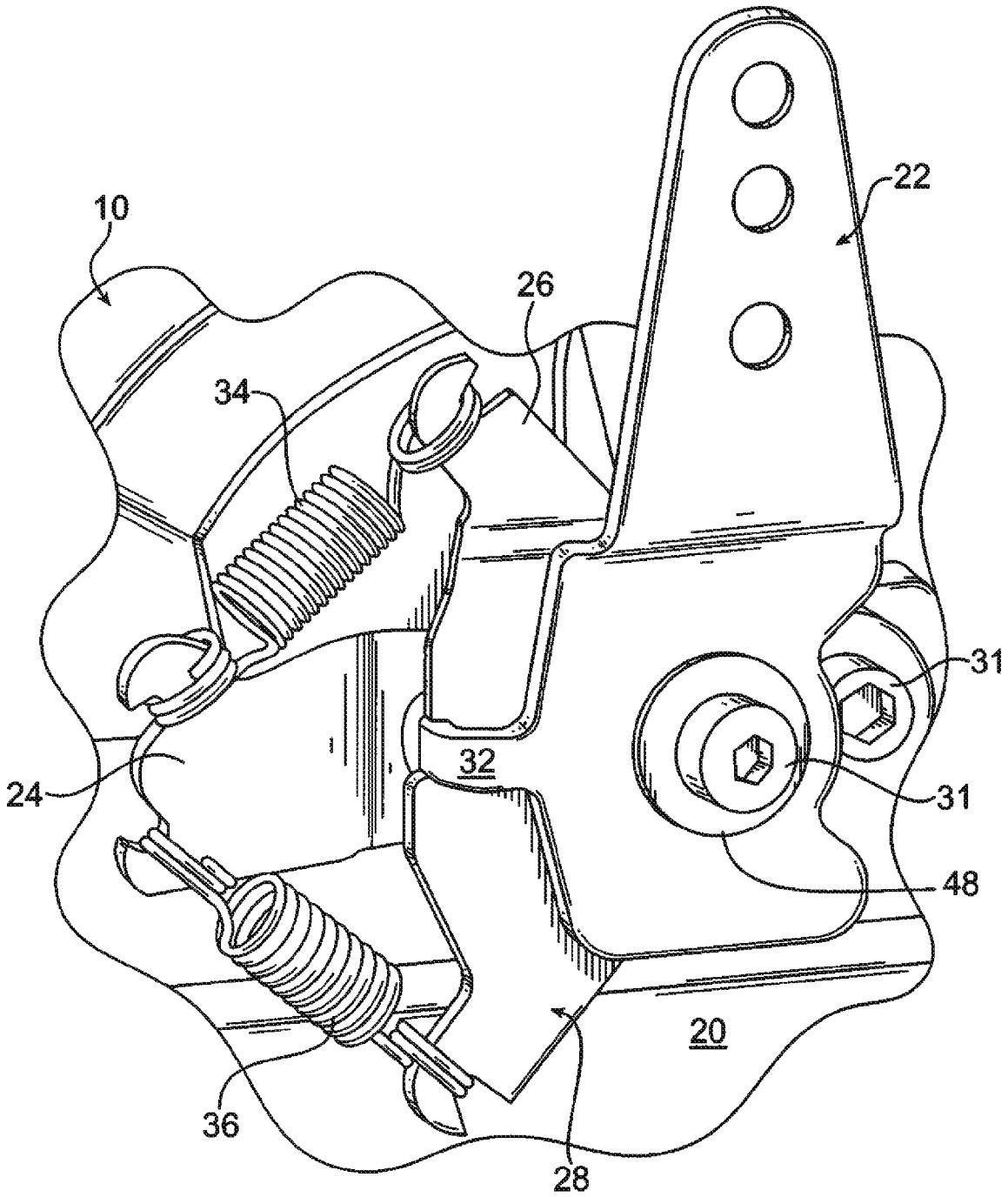
FIG. 2 is a perspective view a hydraulic apparatus having the return to neutral mechanism of FIG. 1 assembled on a hydraulic apparatus and shown in a neutral position.

The present invention is directed toward a hydraulic apparatus with a return to neutral mechanism. FIG. 2 illustrates a portion of an exemplary hydraulic apparatus 10. The hydraulic apparatus of FIG. 2 is an axial piston pump 10. The axial piston pump 10 includes a rotating group (not shown) and an associated swash plate (not shown). A trunnion arm is associated with the swash plate and controls rotation of the swash plate. FIG. 2 also illustrates a return to neutral mechanism 20. The return to neutral mechanism 20 is attachable to a housing 30 of the pump 10 and acts to bias the trunnion arm into a neutral position in which displacement of the pump 10 is zero. The return to neutral mechanism 20 is shown in FIG. 1 in an exploded view and includes a first rotatable bracket 22 fixably attached to the trunnion arm by fastener 31 and rotatable with the trunnion arm, a second stationary bracket 24 fixed to the housing 30 by fastener 31, and a third rotatable bracket 26 and a fourth rotatable bracket 28. The third and fourth brackets are secured to the trunnion arm in a slip fit manner. The trunnion arm extends through the brackets which are secured to the trunnion arm by a fastener 31 and washer 48 as shown. The first rotatable bracket 22 includes an extension portion 32 shown extending generally perpendicular to the remainder of the first rotating bracket 22. The return to neutral mechanism 20 includes a first biasing means and a second biasing means shown as a springs 34, 36, respectively. In one embodiment, spring 34 has a different spring constant than spring 36 to provide a different force for each direction of input arm rotation. This allows one to fully customize and tailor the force and operational bias to each application's. Prior art designs have a single spring to create the return force which limits the ability to tune the mechanism for optimized performance in the forward or reverse direction based on customer preference.

Spring 34 is attached to the stationary bracket 24 and the third rotatable bracket 26. Spring 34 biases the second rotatable bracket 26 toward the extension portion 32 of the first rotatable bracket 22 and toward a stop portion 25. The stop portion 25 can be either a portion of the stationary bracket 25 as shown in FIG. 1, or a portion of the housing 30 extending through an aperture of the stationary bracket 25. Spring 36 is attached to the stationary bracket 24 and the fourth rotatable bracket 28. Spring 36 biases the fourth rotatable bracket 28 toward the extension portion 32 of the first rotatable bracket 22 and toward stop portion 25.

Figure 3:
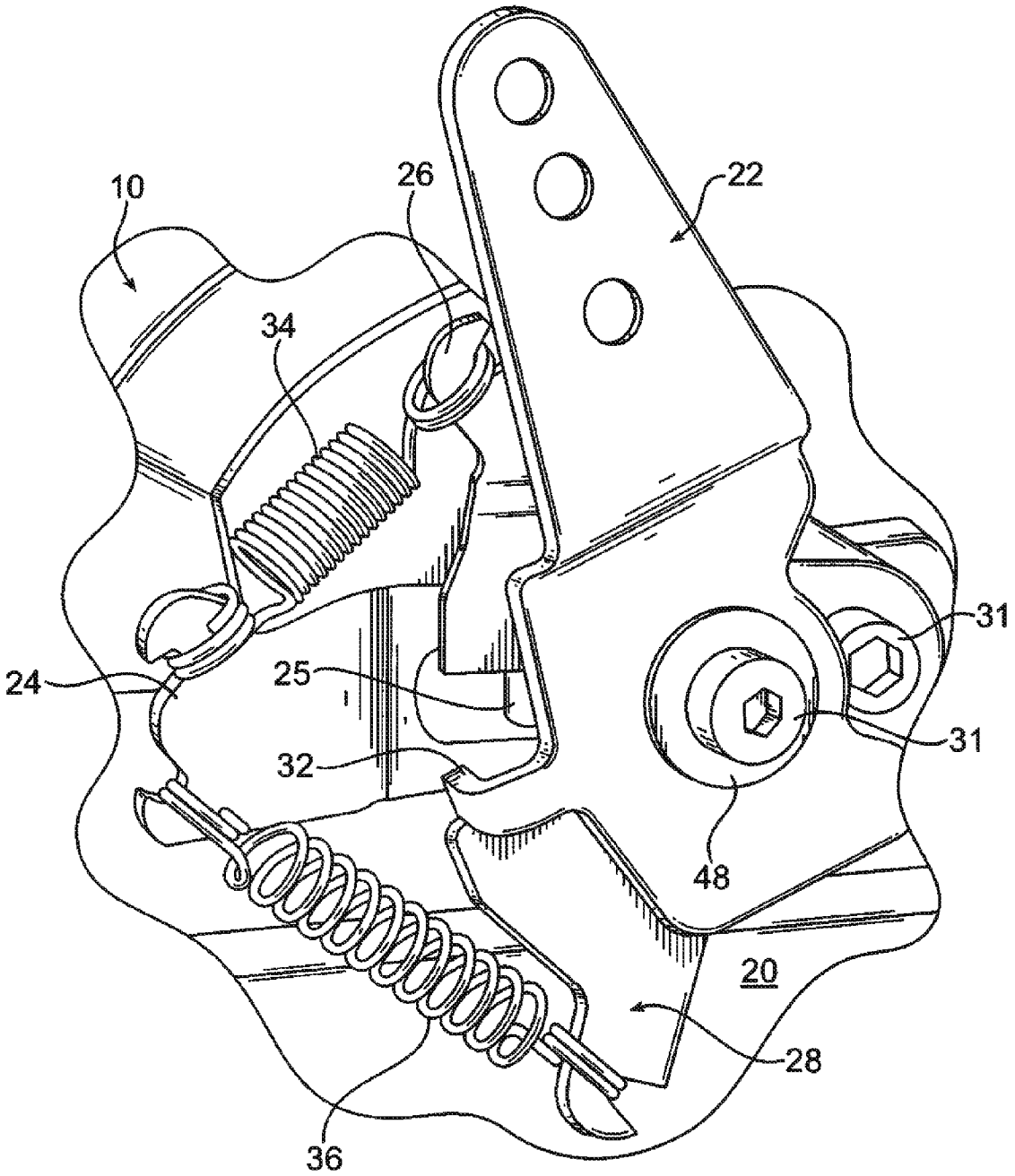
FIG. 3 is a perspective view of the hydraulic apparatus having a return to neutral mechanism of FIG. 2, shown in a first operating condition.
Figure 4:
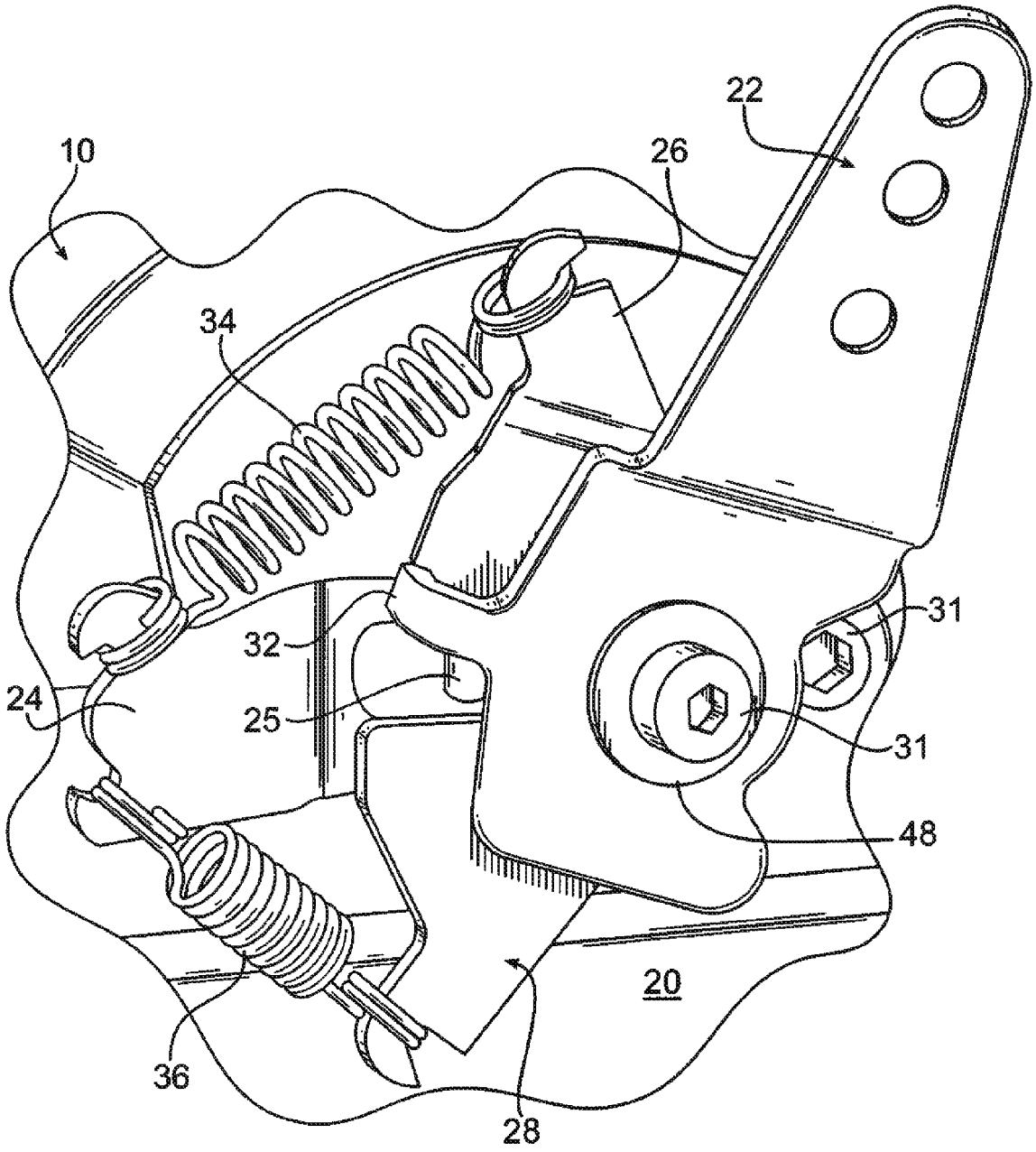
FIG. 4 is a perspective view of the hydraulic apparatus having a return to neutral mechanism of FIG. 2, shown in a second operating condition.
Figure 5:
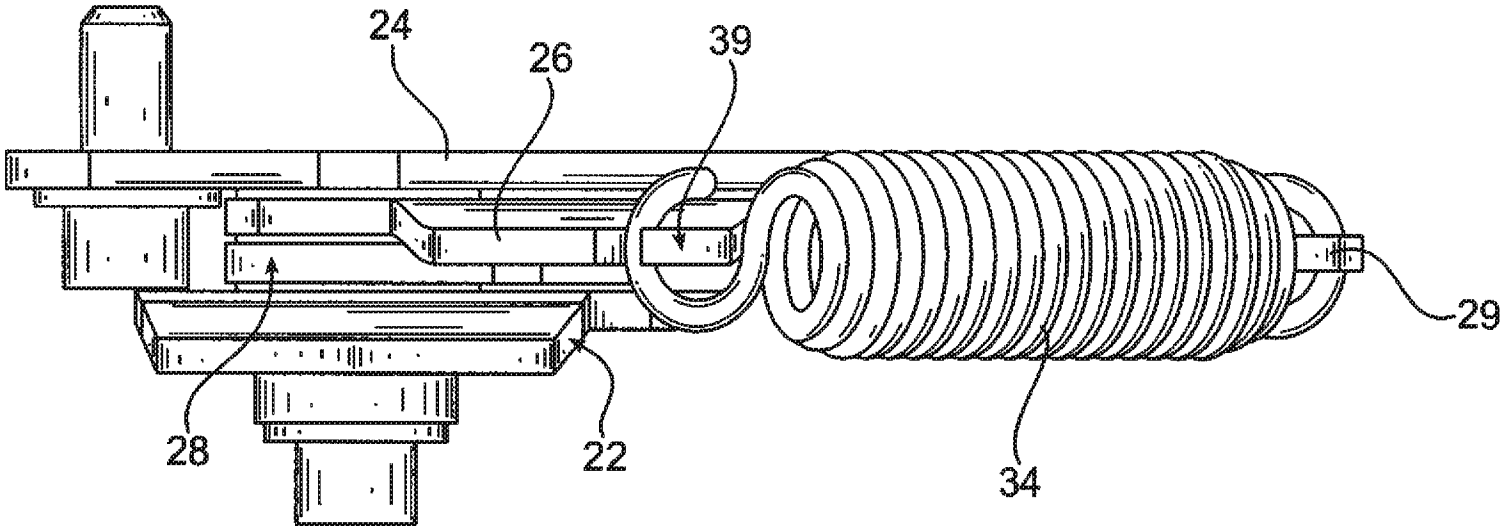
FIG. 5 is a top elevational view showing the spring attachment portions of the brackets in a single plane.
Figure 6:
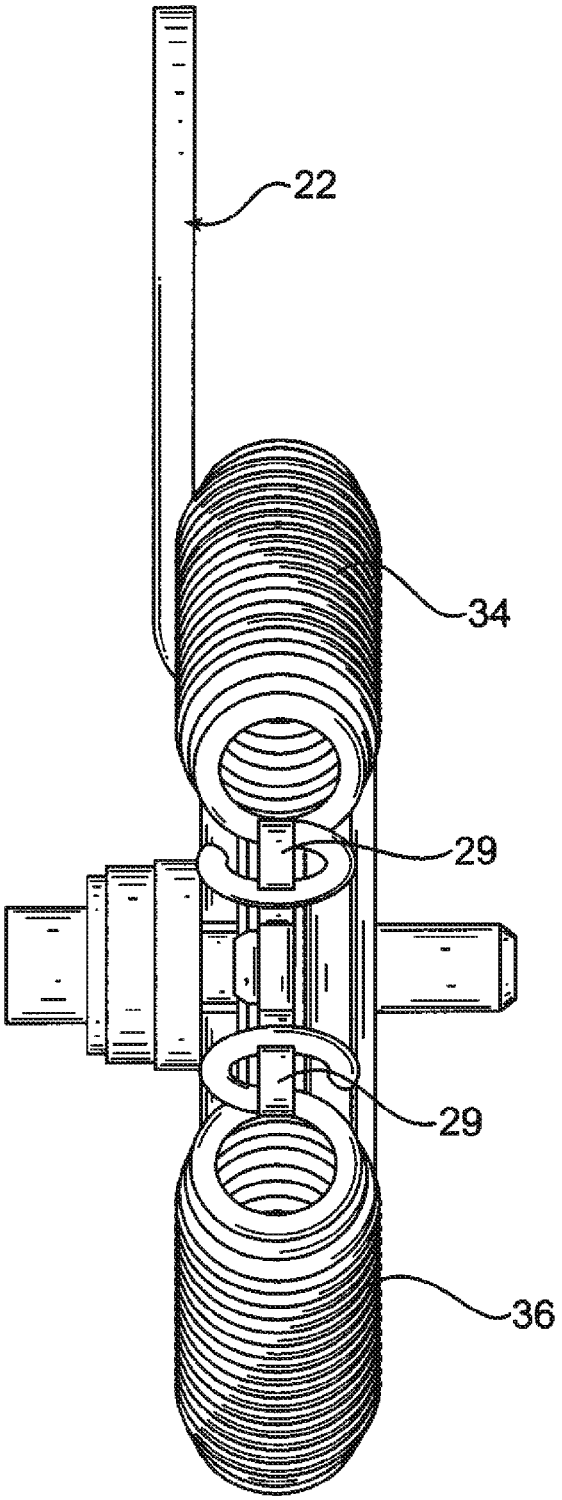
FIG. 6 is a side elevational view showing the spring attachment portions of the brackets in a single plane.

The operation of the return to neutral mechanism 20 of the pump 10 is shown in the FIGS. 2-3. Referring now to FIG. 2, the springs 34, 36 bias the first rotatable bracket 22 into the neutral position against stop 25. The operator activates the pump 10 to operate in a first direction by causing rotation of the first rotatable bracket 22 as shown in FIG. 3. It is noted that the extension portion 32 of the first rotating bracket 22 engages the third rotating bracket 26 forcing the third rotating bracket 26 to move against the biasing force of the spring 34. It is also noted that the fourth rotating bracket 28 does not move. When the operator releases the force holding the first rotatable bracket 22 in position, the spring 34 biases the third rotating bracket 26 and, through the engagement of the extension portion 32, the first rotating bracket 22 back to the neutral position and held against stop 25 by the biasing forces of the springs 34, 36 as shown in FIG. 2. The operator activates the pump 10 to operate in a second direction by causing rotation of the first rotatable bracket 26 as shown in FIG. 4. The extension portion 32 of the first rotating bracket 22 engages the fourth rotating bracket 28 forcing the fourth rotating bracket 28 to move against the biasing force of the spring 36. It is also noted that the third rotating bracket 26 does not move. When the operator releases the force holding the first rotatable bracket 22 in position, the spring 36 biases the fourth rotating bracket 28 and, through the engagement of the extension portion 32, the first rotating bracket 22 back to the neutral position and held against stop 25 by the biasing forces of the springs 34, 36 as shown in FIG. 2. The first rotating bracket 22 includes one or more provisions 42 for attachment to a linkage (not shown) for rotating the trunnion arm. The second stationary bracket 24 includes a longitudinal portion that includes first and second through holes or slots. One through hole 37 is configured for receiving a fastener 31 for fixing the second stationary bracket 24 to the housing 30. The other through hole 41 is sized for receiving the trunnion arm in a slip fit manner such that the trunnion arm may rotate relative to the second stationary bracket 24. The trunnion arm, along with the bolt 31, helps to maintain the position of the second stationary bracket 24 relative to the housing 30. The second stationary bracket 24 also includes arm portions 29 that extend from the second stationary bracket 24 to provide attachment locations for springs 34, 36. The third bracket 26 includes arm portion 39 that extends from the third bracket 26 to provide an attachment location for spring 34 and fourth bracket 28 includes arm portion 43 that extends from the third bracket 28 to provide an attachment location for spring 36. It is noted that arm portions 29, 39, and 43 are positioned in a single plane when assembled as best shown in FIGS. 5 and 6. Aligning the bracket portions in a single plane gives the force mechanism the ability to apply the force in a direct path, reducing friction, increasing life, and improving accuracy.

Prior art return to neutral mechanisms use up to five plates in addition to the trunnion bracket arm 22 to perform the return to neutral function, the present invention uses only one fixed bracket 24 and two rotatable brackets 26, 28. Other designs have a "scissor" effect with plates moving back a forth across each other similar to a pair of scissors. This design utilizes a "pinching claw" type mechanism which works more like a pair of grill tongs or a lobster claw, the force arms are in-line and do not cross.

Although the principles, embodiments and operation of the present invention have been described in detail herein, this is not to be construed as being limited to the particular illustrative forms disclosed. They will thus become apparent to those skilled in the art that various modifications of the embodiments herein can be made without departing from the spirit or scope of the invention. Accordingly, the scope and content of the present invention are to be defined only by the terms of the appended claims.

What is claimed is:

1. A hydraulic apparatus comprising:

a housing;

a trunnion arm extending from the housing;

a first bracket rotationally coupled to the trunnion arm;

a second bracket fixed to the housing;

a third bracket rotatable about the trunnion arm;

a fourth bracket rotatable about the trunnion arm;

a first biasing member biasing third bracket to move the first bracket toward a neutral position of the trunnion arm when the first bracket is rotated in a first direction; and a second biasing member biasing the fourth bracket to move the first bracket toward the neutral position of the trunnion arm when the first bracket is rotated in a second direction.

2. The hydraulic apparatus of claim 1, wherein the apparatus is an axial piston pump.

3. The hydraulic apparatus of one of claims 1, the first rotating bracket including an extension portion which extends outward from a remaining portion of the first rotating bracket.

4. The hydraulic apparatus of claim 3, the third rotating bracket and the fourth rotating bracket are biased against the extension portion of the first rotating bracket.

5. The hydraulic apparatus of claim 1, the second bracket including an anchor portion which provides an attachment location for the first and second biasing members.

6. The hydraulic apparatus of claim 1, the second bracket including a stop portion, the stop portion positioned to prevent rotation of the third bracket beyond the neutral position of the trunnion and to prevent rotation of the fourth bracket beyond the neutral position of the trunnion.

7. The hydraulic apparatus of claim 1, the housing including a stop portion, the stop portion positioned to prevent rotation of the third bracket beyond the neutral position of the trunnion and to prevent rotation of the fourth bracket beyond the neutral position of the trunnion.

8. The hydraulic apparatus of claim 1, wherein the first biasing member and the second biasing member are springs having different spring constants such that they provide different biasing forces.

9. The hydraulic apparatus of claim 1, wherein at least the portions of the third bracket and the fourth bracket that are attached to the biasing members are aligned to a single plane.

10. The hydraulic apparatus of claim 9, wherein the portion of the second bracket that is attached to the biasing members is in the same plane as at least the portions of the third bracket and the fourth bracket that are attached to the biasing members.

11. The hydraulic apparatus of claim 1, wherein arm portions of the third and fourth brackets do not cross each other.

12. A hydraulic apparatus, comprising:

a housing;

a trunnion rotatably mounted in the housing;

a first bracket arm fixedly attached to the trunnion;

a return to neutral assembly comprising:

a second bracket fixed to the housing;

a third bracket rotatable about the trunnion arm;

a fourth bracket rotatable about the trunnion arm;

a first biasing member attached to the third bracket and the second bracket, the first biasing member biasing the third bracket against the first bracket and toward a neutral position when the first bracket is rotated in a first direction;

a second biasing member attached to the fourth bracket and the second bracket, the second biasing member biasing the fourth bracket against the first bracket and toward a neutral position when the first bracket is rotated in a second direction;

wherein the fourth bracket does not move when the first bracket arm is rotated in a first direction and the third bracket does not move when the first bracket arm is rotated in a second direction.

13. The hydraulic apparatus of claim 12, wherein the apparatus is an axial piston pump.

14. The hydraulic apparatus of one of claims 12, the first rotating bracket including an extension portion which extends outward from a remaining portion of the first rotating bracket.

15. The hydraulic apparatus of claim 14, the third rotating bracket and the fourth rotating bracket are biased against the extension portion of the first rotating bracket.

16. The hydraulic apparatus of claim 12, the second bracket including an anchor portion which provides an attachment location for the first and second biasing members.

17. The hydraulic apparatus of claim 12, wherein the first biasing member and the second biasing member are springs having different spring constants such that they provide different biasing forces.

18. The hydraulic apparatus of claim 12, wherein at least the portions of the third bracket and the fourth bracket that are attached to the biasing members are aligned to a single plane.

19. The hydraulic apparatus of claim 12 further comprising a stop portion on either the housing or the second bracket, the stop portion positioned to prevent rotation of the third bracket beyond the neutral position of the trunnion and to prevent rotation of the fourth bracket beyond the neutral position of the trunnion.

20. A method of returning a trunnion arm of a hydraulic apparatus to a neutral position when it is rotated away from the neutral position, the method comprising the steps of:

providing a return to neutral mechanism having a first bracket arm fixedly attached to the housing, a second arm mounted to a housing of the hydraulic apparatus, a third and fourth bracket rotatable about the trunnion arm, and a first biasing member attached to portions of the second bracket and the third bracket that are positioned in a single plane, and a second biasing member attached to portions of the second bracket and the fourth bracket that are positioned in a single plane;

biasing the first bracket arm toward the neutral position using the first biasing member when the first bracket arm is rotated in a first direction; and biasing the first bracket arm toward the neutral position using the second biasing member when the first bracket arm is rotated in a first direction.

* * * * *